US006125730A

United States Patent [19]

Jacques

[11] Patent Number: 6,125,730

[45] Date of Patent: Oct. 3, 2000

[54] DUAL WEB SINGULATING CUTTER

[75] Inventor: Roger A. Jacques, Rochester, N.H.

[73] Assignee: Moore U.S.A. Inc., Grand Island, N.Y.

[21] Appl. No.: 09/232,227

[22] Filed: Jan. 19, 1999

Related U.S. Application Data

[62] Division of application No. 08/935,492, Sep. 23, 1997, Pat. No. 5,953,971.

[51] Int. Cl.[7] ..... B65H 39/02

[52] U.S. Cl. ..... 83/408; 33/113; 270/52.09

[58] Field of Search ..... 83/26–27, 44, 83/47, 110, 404.2, 408, 102, 113, 155; 270/52.09, 52.17, 58.07

[56] References Cited

U.S. PATENT DOCUMENTS

| | | | |
|---|---|---|---|
| 1,348,553 | 8/1920 | Dowell . | |
| 2,214,593 | 9/1940 | Mustin et al. . | |
| 3,489,043 | 1/1970 | Dent . | |
| 3,882,765 | 5/1975 | Tokuno . | |
| 4,007,652 | 2/1977 | Shinomiya et al. . | |
| 4,593,893 | 6/1986 | Suter | 270/52.5 |
| 4,629,172 | 12/1986 | Kemeyama et al. . | |
| 4,696,464 | 9/1987 | Gammerier . | |
| 4,727,784 | 3/1988 | Sarka et al. . | |
| 4,769,969 | 9/1988 | Minami | 53/117 |
| 4,919,027 | 4/1990 | Littleton . | |
| 4,932,932 | 6/1990 | Schmidt et al. . | |
| 4,939,888 | 7/1990 | Katz et al. . | |
| 5,016,801 | 5/1991 | Gilat et al. . | |
| 5,104,104 | 4/1992 | Mol . | |
| 5,293,797 | 3/1994 | Spalding et al. . | |
| 5,297,783 | 3/1994 | Howard et al. . | |
| 5,348,278 | 9/1994 | Ring . | |
| 5,374,042 | 12/1994 | Ring . | |
| 5,768,959 | 6/1998 | Lorenzo . | |

*Primary Examiner*—Rinaldi I. Rada
*Assistant Examiner*—T. Anthony Vaughn
*Attorney, Agent, or Firm*—Nixon & Vanderhye P.C.

[57] ABSTRACT

A method and apparatus for producing an array of individual business forms from a web allow two or more sets of forms from a single web to be formed and integrated in a final array, preferably an in seriatim array with a spacing between the individual forms. A web at least two sheets wide is moved in a first direction and slit to produce at least two web sections. The two web sections are redirected so that they move in different paths, such as by stationary curved surfaces that are vertically spaced from each other and disposed at different angles to the horizontal. Typically the web sections are redirected so that they are substantially vertically aligned with each other. Then the two web sections are cut into individual sheets and the individual sheets are redirected and combined into a single array of sheets with alternating sheets in the array from alternating web sections. During redirecting and combining the sheets are sped up substantially immediately after cutting so that they move at a new speed which is at least twice as great as the earlier speed.

19 Claims, 2 Drawing Sheets

DUAL WEB SINGULATING CUTTER

This is a divisional of application Ser. No. 08/935,492, Sep. 23, 1997, now U.S. Pat. No. 5,953,971.

BACKGROUND AND SUMMARY OF THE INVENTION

In the production of individual sheets from webs, particularly in the manufacture of individual preprinted business forms, it is desirable to produce large webs at one stage, and then to subsequently break up the webs into individual forms. However, in some circumstances it is highly desirable to integrate the forms produced side by side in a larger web in the final array of business forms produced. The present invention provides a method and apparatus for cost effectively accomplishing that function.

The method and apparatus according to the present invention use two or more cutters that act on individual web sections after they are slit from a main web at least two individual sheets (typically business forms) wide. The cutters are synchronized in a particular manner, the web sections are fed to the cutters, and the individual sheets removed from the cutters in such a manner so that an array of sheets (typically business forms) is produced with alternating sheets in the array from alternating web sections. Such a construction provides high reliability while obtaining high speed operation in an on-line environment. Also such a system reduces the complexity of the equipment downstream from the cutters, is simple and easy to use and construct, and has a relatively small "footprint" so that floor space taken up is relatively small. While the invention is particularly suitable for producing an in seriatim array of sheets, with a spacing between the sheets (which spacing may be adjustable by controlling the speed of operation of components downstream of the cutters) practice of the method and operation of the apparatus may be modified to also produce shingled sheets, or sheets stacked one on top of the other.

According to one aspect of the present invention a method of producing an array of sheets from a web is provided comprising the following steps: (a) Moving a web, at least two sheets wide, in a first direction. (b) While practicing step (a), slitting the web to produce at least two web sections. (c) Redirecting the two web sections from step (b) so that they move in different paths. (d) Cutting the two web sections into individual sheets. And (e) redirecting and combining the individual sheets into a single array of sheets with alternating sheets in the array from alternating web sections.

Step (c) is typically practiced by redirecting the two web sections so that they are substantially vertically aligned with each other prior to the practice of step (d). Step (d) is preferably practiced using different cutters for the different web sections that are synchronized and out of phase with each other. When only two web sections are involved (rather than more) the cutters are substantially 180° out of phase with each other.

Steps (a) through (d) are typically practiced while the web or web sections are moving at a first linear speed, and step (e) is also practiced at the speed of the sheet substantially immediately after cutting so that they move at a second linear speed, at least about twice as great as the first speed (where two web sections are provide) at least three times great for three web sections, etc. While other modifications are possible (such as shown per se in U.S. Pat. No. 4,696,464), steps (a) through (e) are typically practiced to produce an in seriatim array of sheets with a spacing between the sheets determined by the increase in speed provided during the practice of step (e). Step (c) is preferably practiced to move the web sections in first and second different substantially vertical loops, the first loop having a greater length than the second loop so that the web section in the first loop leads the web section in the second loop by the length of an individual sheet formed in the practice of step (d) divided by two.

In the preferred manner of operation, the web used in step (a) comprises a web of pre-printed paper business forms, and the individual sheets in the array of step (e) are individual pre-printed paper business forms.

According to another aspect of the present invention the apparatus for producing an array of individual sheets from a web is provided. The apparatus comprises the following components: Means for moving a web at least two sheets wide in a first direction. Means for slitting the web while moving in the first direction to produce at least two web sections. Means for redirecting the two web sections so that they move in different paths, Means for cutting the two web sections into individual sheets. And means for redirecting and combining the individual sheets into a single array of sheets with alternating sheets in the array from alternating web sections.

The means for cutting the two (or more) web sections into individual sheets may comprise any conventional structure that allows synchronized cutting of the web sections into sheets. While any conventional construction may be used, in the preferred embodiment of the invention the means comprise first and second sets (or more sets if more than two web sections are slit from the original web) of cutting and anvil cylinders. Preferably the cutting cylinders each have a cutting blade, and where two web sections are provided the cutting blades of the cutting cylinders are substantially 180° out of phase. The cutting and anvil cylinders of the various sets are preferably either synchronized electrically, or mechanically driven together so as to maintain the appropriate phase relationship between the cutting blades. Of course, the cylinders can be larger so that two or more cutting blades are provided for each cylinder, in which case each of the corresponding sets of cutting blades from each of the cutting cylinders are substantially 180° out of phase.

The means for slitting the web while moving in the first direction may comprise any conventional slitting mechanism including (but not limited to) rotating wheel cutters, reciprocating blades, scissors cutters, etc.

The means for redirecting two web sections so that they move in different paths may also comprise any conventional components which can accomplish that general function, including rollers, movable carriages, stationary guides whether angled, straight line, or curved, or the like. In the preferred embodiment the means for redirecting the two web sections so that they move in different paths comprise means for redirecting the two web sections so that they are substantially vertically aligned with each other prior to contacting the cutting means. For example, the means for redirecting the two web sections may comprise a first set of first and second curved surface elements (which may be rollers, but preferably comprise stationary curved surface elements) that are vertically spaced from each other, and disposed at different angles to the horizontal. Also, a second set of first and second curved surface elements (rollers or stationary elements) may be provided that are vertically and horizontally spaced from each other and closer to the cutting means than the curved surface elements.

The means for redirecting and combining the individual sheets into a single array of sheets may also comprise any conventional structure that accomplishes that purpose including merger/singulator modules, complex conveyor systems such as shown in U.S. Pat. No. 4,696,464, or the like. However, for simplicity and reliability the means for redirecting and combining the individual sheets preferably comprises first and second sets of gripper rollers for gripping sheets while being cut by the cutting means, and first and second singulating conveyor belt assemblies cooperating with the first and second sets of gripper rollers, respectively. The first and second singulating conveyor belt assemblies may include top and bottom belt sections, and a central converging belt section between the top and bottom belt sections. The central converging belt section may comprise a first belt subsection cooperating with the top belt section, and a second belt subsection cooperating with the bottom belt section, and a common roller of the first and second belt subsections between the top and bottom belt sections. The belts used with the common roller may comprise spaced individual conveyor belts or tapes.

The means for moving the web that is at least two sheets wide in the first direction may comprise any suitable conveying apparatus. Some examples of conventional apparatus that may be used for that purpose include sets of drive rollers, with or without idler rollers or redirecting rollers, pin feed tractors, pressure feed tractors, air blast drives, etc., powered by any suitable source of power including electric motors, hydraulic motors, fluidic motors or the like.

While the apparatus is typically operated so that means for redirecting and combining the individual sheets produces an in seriatim array of sheets, with spacing between the sheets determined by the increase in speed provided by the means for redirecting and combining the individual sheets compared to the speed of the means for moving the web in the first direction, the apparatus may also be operated to provide an individual sheet stacked one on top of the other, or shingled with any degree of displacement in the shingling operation.

The increase in speed provided by the means for redirecting and combining individual sheets may be accomplished by utilizing mechanically tied together components having particular (and perhaps adjustable otherwise variable) gear ratios or pulley ratios, or by utilizing conventional computer controls which synchronize operation of various motors and provide for a speed differential operation thereof.

It is a primary object of the present invention to effectively and relatively simply and reliably produce an array of sheets from a web at least two sheets wide. This and other objects of the invention will become clear from an inspection of the detailed description of the invention and from the appended claims.

DETAILED DESCRIPTION OF THE DRAWINGS

Figure 1:
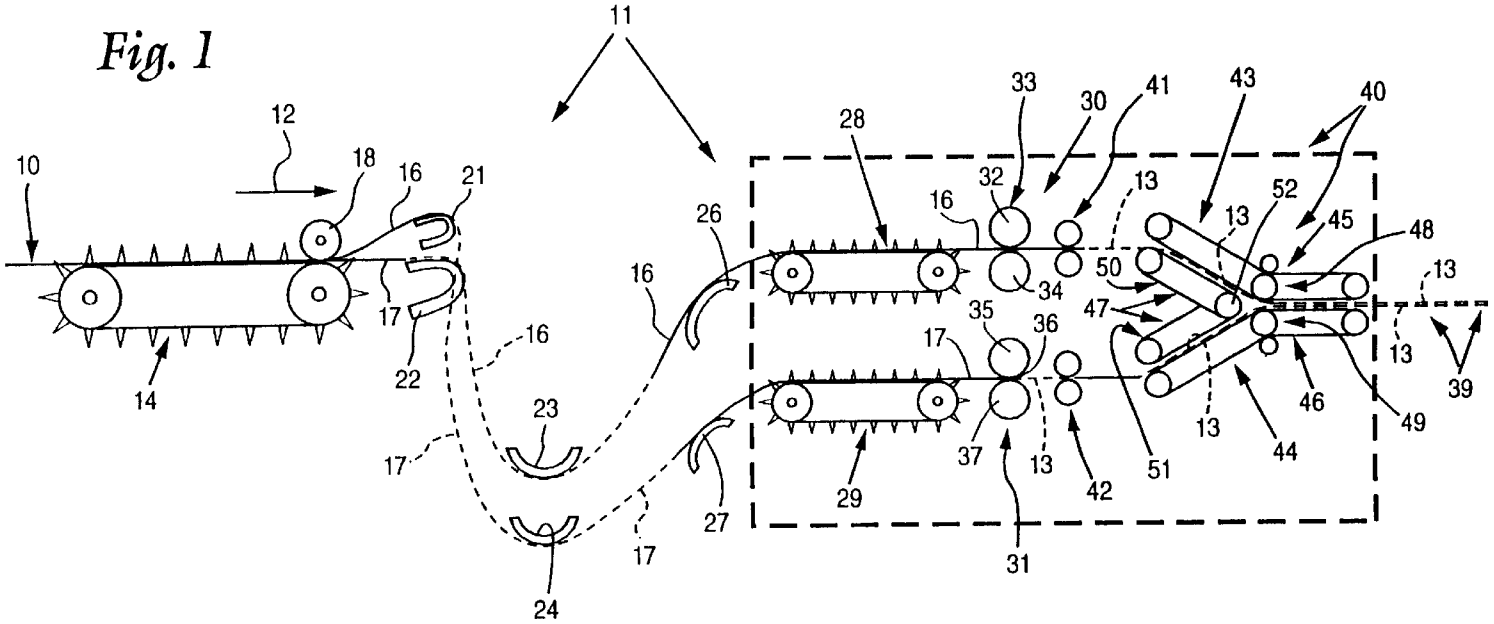
FIG. 1 is a side schematic view of the exemplary apparatus according to the present invention for practicing the method according to the present invention.

FIG. 1 schematically illustrates the basic apparatus for producing an array of individual sheets from a web 10, according to the invention. The apparatus is shown only schematically in FIG. 1 because a wide variety of different components may be utilized to perform the various functions, and the individual components are all, per se, conventional, most being able to be obtained off the shelf.

Figure 2:
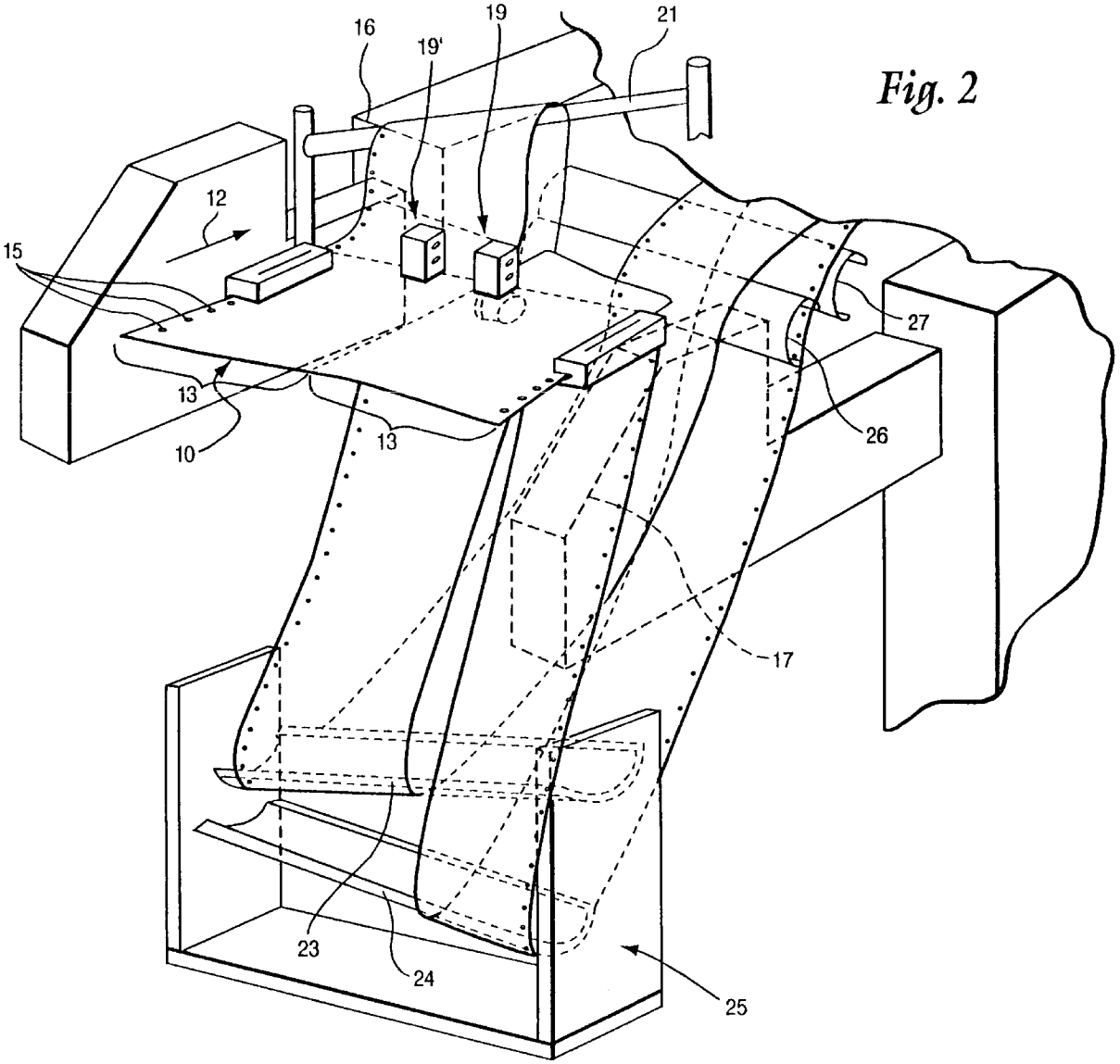
FIG. 2 is a top perspective view of one exemplary form that the slitting and redirecting means for the apparatus of FIG. 1 might take, and showing an alternative manner of aligning the web sections after redirection.

The apparatus according to the present invention, shown generally by reference numeral 11 in FIG. 1, includes means for moving the web 10 in a first direction 12. The web 10—as illustrated in FIG. 2—is at least two individual sheets 13 wide (that is in a dimension perpendicular to the feed direction 12), and may be three or more sheets wide if the components used in the practice of the present invention are suitably multiplied. Preferably the web 10 comprises a web of preprinted business forms, so that the sheets 13 are individual preprinted business forms.

The means for moving the web 10 in the first direction 12 may comprise any conventional web moving equipment. Examples of such equipment include powered rollers, with or without idler or redirecting rollers, pressure feed tractors, or pin feed tractors. In the embodiment illustrated in FIG. 1, a pin feed tractor 14 is schematically illustrated, having conventional pins which cooperate with the conventional tractor holes 15 (see FIG. 2) provided at the edges of the web 10. Where tractor feed holes 15 are utilized, they may be slit off or otherwise separated from the web 10 at any suitable point during the manufacture, as is conventional.

The apparatus 11 also includes means for slitting the web 10 while moving in the first direction 12 to produce at least two web sections 16, 17. The slitting means may comprise any conventional slitting mechanism, such as a rotating slitting wheel as illustrated schematically at 18 in FIG. 1, or a slitting blade cooperating with a rotatable anvil as illustrated schematically at 19 in FIG. 2, or any other conventional slitting structure. The position of the slitting element (18, 19) with respect to the web 10 may be adjustable. As shown in FIG. 2, two or more slitting mechanisms, such as the additional slitter 19', may be provided in case the web 10 is more than two sheets 13 wide, or in case the web 10 is being slit so that the individual sheets 13 have different widths (in the direction perpendicular to the feed direction 12).

The apparatus 11 also comprises means for redirecting the two web sections 16, 17 so that they move in different paths—preferably so that they are substantially vertically aligned with each other when moved in different paths prior to being cut into individual sheets, as schematically illustrated in both FIGS. 1 and 2. The redirecting means may comprise any conventional structures that are capable of redirecting the web so that it accomplishes the objectives according to the invention, including rollers, whether powered or idler, gripping tractors, stationary web engaging surfaces whether straight line or curved, etc. In the preferred embodiment illustrated in the drawings, the redirecting means comprise a series of sets of curved surfaces (preferably stationary for cost savings, although rollers can be used if necessary), and feed conveyors.

For example, the web section 16 is first moved outwardly by a first curved surface stationary element 21 while the second web section 17 is redirected by a second stationary curved surface element 22, the elements 21, 22 providing a first set of elements. A second set of elements further redirect the web sections 16, 17, the second set of such elements comprising a first curved surface stationary element 23 that engages the web section 16, and a second curved surface element 24 which engages the web section 17. As seen in both FIGS. 1 and 2, the elements 23, 24 are preferably stationary and vertically spaced from each other, and as seen in FIG. 2 the elements 23, 24 are preferably disposed at different angles to the horizontal. The elements 23, 24 may be mounted in any suitable manner, such as in the U-shaped stationary support structure 25 as seen in FIG. 2.

The redirecting means may also comprise the third set of first and second curved (preferably stationary) surface elements 26, 27 which engage the web sections 16, 17, respectively, and the redirecting means may also comprise the conveying structures 28, 29 (see FIG. 2). The structures 28, 29 may be any suitable conveying structures such as rollers, pressure tractors, or the like. In the schematic illustration in FIG. 1 the conveying sections 28, 29 are illustrated as pin feed tractors.

The redirecting means—such as the structures 21 through 29 illustrated in FIGS. 1 and 2—preferably move the web sections 16, 17 in first and second different substantially vertical loops, the first loop having a greater length than the second loop so that web section in the first loop leads the web section in the second loop by the length (in the direction 12) of an individual sheet/business form 13 that is subsequently formed, divided by two (where the web 10 is two sheets 13 wide). By utilizing the particular redirecting structures 21 through 27 illustrated in FIGS. 1 and 2, conveyor sections 28, 29 may be disposed one on top of the other, substantially vertically aligned.

The apparatus 11 further comprises means for cutting the two web sections 16, 17 into individual sheets 13. Cutting means, shown schematically at 30 and 31 in FIG. 1, may comprise any conventional cutting apparatus including linear reciprocating blade, scissors blades, or like cutters. In the preferred embodiment illustrated in FIG. 1, the cutting means 30 comprises a cutting cylinder 32 having at least one radially extending cutter blade 33 that cooperates with the anvil cylinder 34 (the blade 33 is shown with an exaggerated length in FIG. 1 merely for clarity of illustration). For each rotation of the cylinders 32, 34, the blade 33 comes into contact with the web section 16, cutting an individual sheet 13 having a length corresponding to the circumference of the cylinders 32, 34. More than one cutting blade 33 may be provided for each cylinder 32, depending upon the length of sheets 13 to be cut, or different circumferences of cutting cylinders 32 may be utilized if different sheet 13 lengths are required.

The cutter 31 comprises a second cutting cylinder 35 having a cutting blade 36 and cooperating with a second anvil cylinder 37. For the two-wide web 10 construction illustrated in FIGS. 1 and 2, the blade 36 is out of phase with respect to the blade 33 substantially 180° . This out of phase arrangement may be provided by tying the rotation of the cylinders 32, 35 together mechanically utilizing conventional structures for that purpose, or by utilizing suitable conventional computer or electrical control structures.

The cutters 30, 31 are—like the conveyors 28, 29—preferably substantially vertically aligned with each other so that the sheets 13 need not be redirected by any downstream equipment in order to provide them in a desired array.

The apparatus 11 also comprises means for redirecting and combining the individual sheets 13 into a single array of sheets, the array shown schematically at 39 in FIG. 1. In the array 39 alternating sheets 13 are from alternating web sections 16, 17, respectively (where two web sections are provided, but the same arrangement being provided if three or even more web sections are utilized). The redirecting and combining means may comprise any conventional structure for that purpose, such as the complex belt and roller arrangement as illustrated in U.S. Pat. No. 4,696,464, or utilizing conventional merger/singulator modules. However, in the preferred embodiment of the invention the redirecting and combining means is shown generally by reference numeral 40 in FIG. 1, with a component thereof illustrated in FIG. 3.

Figure 3:
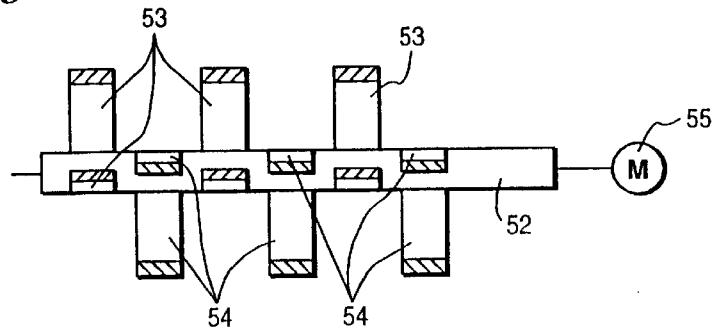
FIG. 3 is a schematic end view, with conveyor belt sections in cross section, showing the common roller of the preferred embodiment for the means for redirecting and combining the individual sheets into a single array as illustrated in FIG. 1.

The redirecting and combining means 40 in the preferred embodiment illustrated in FIGS. 1 and 3 comprises first and second sets of conventional gripper rollers 41, 42 for gripping the sheets 13 while being cut by the cutting means 30, 31, respectively, and first and second singulating conveyor belt assemblies shown schematically at 43, 44. respectively, in FIG. 1, for cooperating with the first and second sets of gripper rollers 41, 42, respectively. The first and second singulating conveyor belt assemblies 43, 44 include a top belt section 45 and a bottom belt section 46, and a central converging belt section 47 between the top and bottom belt sections 45, 46. Each of the belt sections 45, 46 comprises conventional endless belts wrapped around drive and/or idler rollers at ends thereof, and include intermediate redirecting rollers 48, 49, respectively.

The central converging belt section 47 includes a first belt subsection 50 for cooperation with the top belt section 45, and a second belt subsection cooperating with the bottom belt section 46, and a common roller shaft 52 of the first and second belt subsections 50, 51, between the top and the bottom belt sections 45, 46. As seen in FIG. 3*b*, the common roller shaft 52 has a first set of conveyor belts or tapes 53 associated with the first belt subsection 50, and a second set of conveyor belt or tapes 54 associated with the second belt subsection 51. The roller shaft 52 may be powered, as indicated schematically by motor 55 in FIG. 3, and the belt sections 45, 46 may also be powered by the same motor 55 and either geared or pulleyed together.

While the means 40 may provide the individual sheets 13 in any desired configuration, including stacked one on top of the other, shingled, or the like, in the preferred embodiment the array 39 is an in seriatim array. This is accomplished not only by utilizing the out of phase cutters 30, 31 as described above, and the particular redirecting structures 21 through 29 described above, but also by increasing the speed of the individual sheets or forms 13 once they leave the cutters 30, 31. Up until the point that they leave the cutters 30, 31 in the form of sheets 13, the paper of the web 10 or web sections 16, 17 moves in the direction 12 at a first speed. Once leaving the cutters 30, 31 the sheets 13 move at a second speed which is at least twice as great as the first speed, the structure 40 being operated at that second speed. Exactly how much faster than twice as great as the first speed the structure 40 will be operated depends upon what spacing is desired between the sheets 13 and the array 39, and may be adjusted accordingly (e.g. by adjusting the speed of a variable speed motor 55).

It will thus be seen that by utilizing the apparatus of FIGS. 1 through 3 a highly advantageous method of producing an array of sheets from a web 10 is provided. The method comprises the following steps: (a) Moving the web 10, at least two sheets 13 wide (see FIG. 2), in the first direction 12. (b) While practicing step (a), slitting the web (using slitters 18, 19, etc.) to produce at least two web sections 16, 17. (c) Redirecting the two web sections 16, 17 from step (b) so that they move in different paths (utilizing the structures 21 through 29, preferably to move the web sections 16, 17 in first and second different substantially vertical loops as illustrated in FIG. 1, so that the web section of the first loop leads the web section of the second loop by the length of a subsequently formed individual sheet 13, divided by two).

(d) Cutting the two web sections 16, 17 into individual sheets 13 (as by using the cutters 30, 31 which are substantially 180° out of phase with each other). And (e) redirecting and combining the individual sheets into a single array 39 of sheets 13, with alternating sheets in the array from alternating web sections 16, 17. Step (d) is practiced utilizing structures 40, and steps (a) through (d) are practiced while the web 10 or web sections 16, 17 are moving at a first linear speed, and step (e) is practiced to speed up the sheets 13 substantially immediately after cutting so that the sheets 13 move at a second linear speed at least about twice as great as the first speed. Preferably steps (a) through (e) are practiced to produce an in seriatim array 39 of sheets 13, with the spacing between the sheets 13 determined by the increase in speed provided during the practice of step (e).

It will thus be seen that according to the present invention an advantageous method and apparatus have been provided for producing an array of sheets from a web. While the invention has been herein shown and described in what is presently conceived to be the most practical and preferred embodiment thereof, it will be apparent to those of ordinary skill in the art that many modifications may be made within the scope of the invention, which scope is to be accorded the broadest interpretation of the appended claims so as to encompass all equivalent structures and methods.

What is claimed is:

1. Apparatus for producing an array of individual sheets from a web, comprising:

means for moving a web at least two sheets wide in a first direction;

means for slitting the web while moving in the first direction to produce at least first and second web sections;

means for redirecting the first and second web sections so that they move in different paths; means for cutting the first and second web sections into individual sheets; and means for redirecting and combining the individual sheets into a single array of sheets with alternating sheets in the array from alternating web sections.

2. Apparatus as recited in claim 1 wherein said means for cutting the first and second web sections into individual sheets comprises first and second sets of cutting and anvil cylinders.

3. Apparatus as recited in claim 2 wherein said cutting cylinders each have a cutting blade, and wherein said cutting blades of said cutting cylinders are substantially 180° out of phase with each other.

4. Apparatus as recited in claim 3 wherein said means for redirecting the first and second web sections so that they move in different paths further comprise means for redirecting the first and second web sections so that they are substantially vertically aligned with each other prior to contacting said cutting means.

5. Apparatus as recited in claim 4 wherein said means for redirecting the first and second web sections so that they move in different paths further comprise a first set of first and second curved surface elements that are vertically spaced from each other, and disposed at different angles to the horizontal.

6. Apparatus as recited in claim 5 wherein said first and second curved surface elements comprise stationary curved surface elements.

7. Apparatus as recited in claim 6 wherein said means for redirecting the first and second web sections so that they move in different paths further comprise a second set of first and second curved surface elements that are vertically and horizontally spaced from each other and closer to said cutting means than said first set.

8. Apparatus as recited in claim 3 wherein said means for redirecting and combining the individual sheets into a single array of sheets with alternating sheets in the array from alternating web sections comprise first and second sets of gripper rollers for gripping sheets while being cut by said cutting means, and first and second singulating conveyor belts assemblies cooperating with said first and second sets of gripper rollers, respectively.

9. Apparatus as recited in claim 8 wherein said first and second singulating conveyor belt assemblies include top and bottom belt sections, and a central converging belt section between said top and bottom belt sections.

10. Apparatus as recited in claim 9 wherein said central converging belt section comprises a first belt subsection cooperating with said top belt section, and a second belt subsection cooperating with said bottom belt section, and a common roller of said first and second belt subsections between said top and bottom belt sections.

11. Apparatus as recited in claim 1 wherein said means for redirecting the first and second web sections so that they move in different paths further comprise means for redirecting the first and second web sections so that they are substantially vertically aligned with, but vertically spaced from, each other prior to contacting said cutting means.

12. Apparatus as recited in claim 11 wherein said means for redirecting the first and second web sections so that they move in different paths further comprise a first set of first and second curved surface elements that are vertically spaced from each other, and disposed at different angles to the horizontal.

13. Apparatus as recited in claim 12 wherein said first and second curved surface elements comprise stationary curved surface elements.

14. Apparatus as recited in claim 13 wherein said means for redirecting the first and second web sections so that they move in different paths further comprise a second set of first and second curved surface elements that are vertically and horizontally spaced from each other and closer to said cutting means than said first set.

15. Apparatus as recited in claim 14 wherein said means for redirecting and combining the individual sheets into a single array of sheets with alternating sheets in the array from alternating web sections comprise first and second sets of gripper rollers for gripping sheets while being cut by said cutting means, and first and second singulating conveyor belts assemblies cooperating with said first and second sets of gripper rollers, respectively.

16. Apparatus as recited in claim 12 wherein said means for redirecting and combining the individual sheets into a single array of sheets with alternating sheets in the array from alternating web sections comprise first and second sets of gripper rollers for gripping sheets while being cut by said cutting means, and first and second singulating conveyor belts assemblies cooperating with said first and second sets of gripper rollers, respectively.

17. Apparatus as recited in claim 1 wherein said means for redirecting and combining the individual sheets into a single array of sheets with alternating sheets in the array from alternating web sections comprise first and second sets of gripper rollers for gripping sheets while being cut by said cutting means, and first and second singulating conveyor belts assemblies cooperating with said first and second sets of gripper rollers, respectively.

18. Apparatus as recited in claim 17 wherein said first and second singulating conveyor belt assemblies include top and bottom belt sections, and a central converging belt section between said top and bottom belt sections.

19. Apparatus as recited in claim 18 wherein said central converging belt section comprises a first belt subsection cooperating with said top belt section, and a second belt subsection cooperating with said bottom belt section, and a common roller of said first and second belt subsections between said top and bottom belt sections.

* * * * *